US007089495B2

(12) United States Patent
Barrows

(10) Patent No.: US 7,089,495 B2
(45) Date of Patent: Aug. 8, 2006

(54) VIDEO ENHANCED GRAVEMARKER

(76) Inventor: Robert M. Barrows, 205 Park Rd., Suite 208, Burlingame, CA (US) 94010

( * ) Notice: Subject to any disclaimer, the term of this patent is extended or adjusted under 35 U.S.C. 154(b) by 0 days.

(21) Appl. No.: 10/284,801

(22) Filed: Oct. 31, 2002

(65) Prior Publication Data

US 2004/0085337 A1 May 6, 2004

(51) Int. Cl.
*H04N 5/44* (2006.01)
*E04H 13/00* (2006.01)
*G09B 25/00* (2006.01)

(52) U.S. Cl. ..... 715/717; 369/75.11; 369/69; 360/12; 40/455; 434/378; 52/128

(58) Field of Classification Search ..... 345/717, 345/764, 762, 733; 715/717; 369/19, 69, 369/75.11; 40/55, 455; 360/12; 434/378; 52/128
See application file for complete search history.

(56) References Cited

U.S. PATENT DOCUMENTS 4,455,772 A * 6/1984 Miller ..... 40/124.5
5,404,343 A * 4/1995 Boggio ..... 369/19
5,553,426 A * 9/1996 Ostergaard ..... 52/103
5,729,921 A * 3/1998 Rojas ..... 40/124.5
5,732,231 A * 3/1998 Evans, III ..... 345/716
6,088,973 A * 7/2000 Weiss ..... 52/105
6,132,054 A * 10/2000 Rogers et al. ..... 362/86
6,324,736 B1 * 12/2001 Atrio ..... 27/2
6,340,978 B1 * 1/2002 Mindrum ..... 345/764
6,381,573 B1 * 4/2002 Loudermilk ..... 704/272
6,414,663 B1 * 7/2002 Manross, Jr. ..... 52/134
6,681,534 B1 * 1/2004 David et al. ..... 52/134
6,980,107 B1 12/2005 Ziegler
2001/0036354 A1 * 11/2001 Majors ..... 386/46
2003/0208890 A1 * 11/2003 Kim ..... 27/31
2003/0217120 A1 * 11/2003 Hickey et al. ..... 709/219

OTHER PUBLICATIONS

"Goodbye cruel world" by David Mckie. The Guardian. Manchester, UK: Apr. 2, 1998, p. 201.*
Easton, Thomas A., "Wallflower", Tomorrowsf Magazine, Issue 23, Nov., 1996.
Joey Shamel, "A tombstone with flat-screen video", www.globalideasbank.org/_creend/_ CRE-33.HTML.
Kuehner John C. & Plain Dealer Report, "Someday, tape of deceased may be running on a headstone", www.cleveland.com/printer/printer.ssf?/base/living/1099128929156500.xml, 2 page(s).
Christine Morente, "Inventor lets the dead have final word", San Mateo County Times, Aug. 23, 2004, 1 page.
"Vidstone Homepage", www._vidstone.com, 3 page(s).
Weilun Lo, PCT International Preliminary Examination Report of PCT Serial No. PCT/US03/35177, Sep. 19, 2005, 4 pages.

* cited by examiner

*Primary Examiner*—Weilun Lo
*Assistant Examiner*—Sara Hanne
(74) *Attorney, Agent, or Firm*—Ray K. Shahani, Esq.

(57) ABSTRACT

A tombstone for communicating audio and visual data related to the deceased from the tombstone to a user, the tombstone comprising an indicia bearing and viewing portion, a visual display, an audio transmitter for communicating sound waves to a user, data related to the deceased, the data comprising audio and visual images of the deceased, the data stored within storage media, and means for reproducing the audio and visual images of the deceased from the data related to the deceased utilizing one or more players, readers or drivers for the one or more of the storage media.

9 Claims, 7 Drawing Sheets

VIDEO ENHANCED GRAVEMARKER

FIELD OF THE INVENTION

The present invention relates generally to tombstones, other types of grave markers, columbaria and the like, and more particularly, to video tombstones having an apparatus for playing video or other visual format, a source of video or other visual data comprising a communication from the deceased, and a user interface which provides user access, operation and control of the system.

BACKGROUND OF THE INVENTION

Throughout history and across cultural divisions, a variety of different ceremonies and memorials have been used to commemorate the death of a loved one. Indeed, ceremonies and memorials have become integral for helping the living cope with the death and for commemorating the loved one for future generations. For instance, traditional western ceremonies typically involve a funeral home visitation, a burial, and a wake, with the grave site being marked by a headstone. In the case of cremation, ashes are often placed in a sealed urn. For many historically significant individuals, their deaths are sometimes commemorated with a memorial, such as a statue, which is often dedicated years after that individual's death.

While traditional ceremonies and memorializations are without a doubt important, they do have several shortcomings. For instance, visitors have traditionally been required to be physically located at the ceremony or the memorial to view or reflect on the individual. If you are not physically present at the ceremony or the memorial, you cannot share in the achievements and memories associated with the individual. In the case of many ceremonies, the duration is limited to the actual time of the ceremony. Any reflection after the ceremony is limited to the memories of those who actually attended. A further shortcoming is the relatively limited scope of the commemoration. Visitations typically involve a eulogy and memories shared between the participants. Outside the spoken words of the visitors, however, little or no other memories are shared. In the case of traditional memorials, including headstones, urns, statues and the like, memories and messages are usually limited only to a few words etched in stone or on a plaque.

Typical tombstones and grave markers are formed from carved stone. Columbaria are buildings formed of traditional types of building materials. Unfortunately, these devices do not communicate an audio and visual communication from the deceased to the listener.

U.S. Pat. No. 5,517,791 issued May 21, 1996 to Weiss teaches a monument with movable element. This prior art does not teach the video tombstone of the present invention.

U.S. Pat. No. 5,622,014 issued Apr. 22, 1997 to Weiss teaches a columbarium structure comprising several niche units each of which has a door hingably attached to it, within which door, a rotatable element is rotatably mounted. This prior art does not teach the video tombstone of the present invention.

U.S. Pat. Nos. 6,006,458 and 6,088,973 issued Dec. 28, 1999 and Jul. 18, 2000, respectively, both to Weiss, teach monument markers and columbaria with improved display indicia. This prior art does not teach the video tombstone of the present invention.

U.S. Pat. No. 6,340,978 issued Jan. 22, 2002 to Mindrum teaches a method and apparatus for recording and presenting life stories. This system comprises a computer with database containing a great deal of information about the deceased on a memory chip, rather than provide a communication from the deceased which has been videotaped prior to passing away. Therefore, this prior art does not teach the video tombstone of the present invention either.

OBJECTS AND ADVANTAGES OF THE PRESENT INVENTION

Thus, it is an object and advantage of the present invention to overcome the deficiencies and problems associated with the prior art.

It is a further object and advantage of the present invention to provide an improved method and apparatus for a video tombstone or other video enhanced gravemarker.

SUMMARY OF THE INVENTION

The video-tombstone incorporates a combination television monitor and video playback device (either analog or digital) into a tombstone. The video playback device can also be both a recording and playback device, such as if the deceased wanted to allow people the option of recording messages from other people who might visit the cemetery at a later date. Thus, family members, visitors or other people can record messages to be played back, even after their death.

The video player/recorder is housed in a weatherproof housing and fits into a hollowed out housing in the tombstone portion. Inside the housing, the tombstone can be lined with a thin layer of protective material (most likely rubber) to protect the playback device from getting scratched by the tombstone. The playback device is inserted into the tombstone on light rails that make installation and removal easy.

The size and positioning of the video playback/recording device can vary with the size and shape of the tombstone. A flat screen or rounded screen TV can be used.

The back of the tombstone includes a removable weather protected panel, optionally with a locking device such as for use in public places, that can be accessed to service the television and video playback machine as well as provide an electrical connection. The back panel also optionally has vents to allow airflow and heat exchange. These vents can be covered with vent covers with a mesh to help prevent insects or debris from getting in. The vent covers optionally slide onto small rails on the vents and snap into position, and snap off for maintenance, or replacement, as necessary.

The front of the video tombstone also includes a protective window, optionally made of thin plexiglass or other transparent, protective material, to protect the television screen from the elements and intrusion. A sliding plastic, slightly curved cover shield can also be added to protect the screen from the elements and to blend in with the surroundings. This cover shield can be colored the same color as the tombstone, or different. The sliding front shield would slide on small rails and could be operated by remote control or manually. The purpose of the shield is to hide the screen so the tombstone can blend in with the surroundings as well as to further protect the device from the elements.

In addition, a remote controlled video camera with an omnidirectional microphone can also be added to the tombstone, such as if the deceased person wanted to allow people to record messages for others to see upon visiting the tombstone. The camera is mounted on top of the equipment, within the tombstone to protect it from the elements. A locking, sliding or hinged panel can be added to the protective housing to expose the camera and the microphone to the recording party to produce high quality recorded sound.

The video playback device can also be hooked up to the internet through standard electrical cable and phone or other data connections. The system of the present invention can also be equipped with a transmitter for wireless connection to the internet. In this embodiment, there is a radio transmitter mounted within the tombstone. This transmitter would transmit sound to 2 receivers:

1) A wireless headset, that included a receiver within the headset; or

2) A speaker attachable to the base of the tombstone, or installed in the ground. This speaker is an external speaker. It can also receive sound producing signals over the air from the transmitter or it can be connected by wire to the video equipment within the tombstone. Power for the speaker comes from either a battery or electrical connection.

Optionally, a programmable remote control device can be stored on top of the speaker platform, such as within a lockable box. In most cases, the cemetery office can issue the headsets and remote control devices, and code numbers, to visitors. Code numbers can also be posted on the gravestones themselves such that visitors can punch in their codes on their remote control devices and start the audio-video presentation at various graves.

Power for the machine comes from either a battery or from an electrical outlet, both of which could be located in back of the unit within the housing of the tombstone. If an electrical outlet is used, the conduit can run inside of the video tombstone through a hollow internal "tunnel" through which a wire can run so it can be connected to an outside connection, or it can run through a protective housing attachable to the outside of the back of the tombstone. If it runs through an internal "tunnel" the tombstone can be manufactured with integrated wiring. If it runs on the outside, the sheath could be glued onto the tombstone or screwed into the tombstone. The machine can be activated by a remote control device that is coded to a particular video set and the audio portion of the program is played in speakers on the television set itself, external speakers mounted on the base or elsewhere on the tombstone. The sound transmits over radio frequencies to a headset with a receiver built into it as well as external speakers. Other transmitting systems using infra-red can also be used but may be provided with an additional user interface. The system can also be programmed from a central point by a company that designs audio systems for museums with the Acoustiguide (trademark) system manufactured by the Acoustiguide Company, 630 7th Ave., 17th floor, New York, N.Y. 10001 This system puts the sound content within a device already connected to a headset. The user punches in the number of the display and listens to the recording.

Thus, the person visiting the grave has a remote control device that triggers the video playback device. The video playback device sends the information to the TV monitor. The video is displayed on the TV monitor. The audio channel can be played on the TV, on external speakers, or transmitted to a wireless headset that includes an audio receiver.

Slide rails and rubber siding to ease the video playback device into the tombstone can also be inserted into the tombstone. These rails provide a platform for the video, recording and other equipment which allows for better ventilation, better access, etc. Room for a battery housing is also included in the space for the equipment. At the bottom of the tombstone, where the wires go through to their ground connections, a protective covering with a tube running through to allow the wires to pass through would be added to further protect the interior of the tombstone from the elements and dirt and debris, including insects, etc.

This system can be accessible to the public and be operated by an on-off switch located on the remote control or on the tombstone itself. The device can also be operated by a coded card used in a swiping device, like the programmable cards currently used in many hotel rooms for guests to open their own, individual rooms, or it can even operate on a credit card or coin activated device.

Numerous other advantages and features of the present invention will become readily apparent from the following detailed description of the invention and the embodiments thereof, from the claims and from the accompanying drawings.

BRIEF DESCRIPTION OF THE DRAWINGS

The invention is illustrated below and represented schematically in the following drawings.

DETAILED DESCRIPTION OF THE PREFERRED EMBODIMENT

Figure 1:
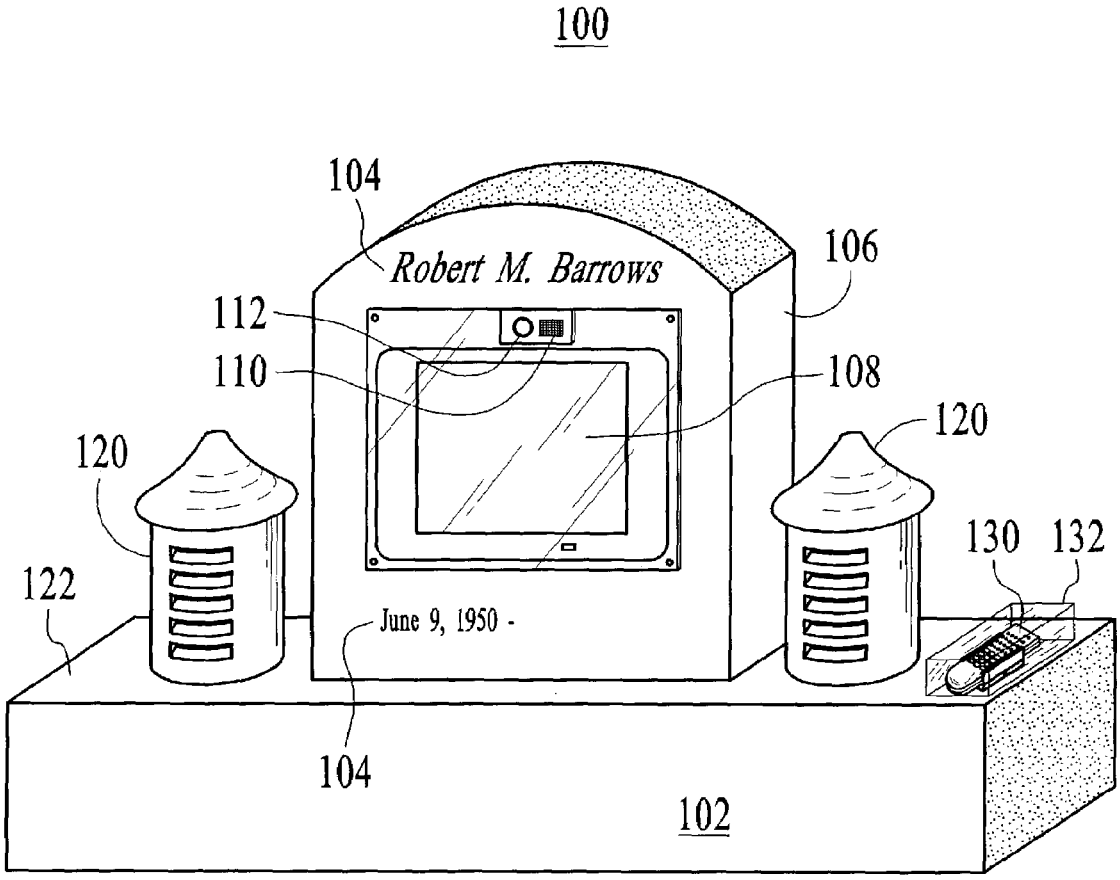
FIG. 1 is a representative isometric front view of a preferred embodiment of an improved apparatus for a video tombstone of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

FIG. 1 is a representative isometric front view of a preferred embodiment of an improved apparatus for a video tombstone 100 of the present invention. A base portion 102 supports the other portions of the video tombstone 100 of the present invention. The indicia 104 bearing housing portion 106 also contains the visual display portion 108. Located above the visual display portion 108 there is a microphone 110 and camera lens 112 or other sensors useful for recording and/or collecting audio and visual data and other data or samples.

It will be understood that the base portion 102 as well as the housing portion 106 can be constructed using typical or traditional tombstone materials, or using composites, carved materials, injection or other types of molded forms, etc.

Speaker housings 120 are mounted on the top surface 122 of the base portion 102. Additionally, a remote control operating wand 130 can be stored in a lockable or other sealed box portion 132. It will also be understood that the speakers (not shown) or wand 130 can also be mounted within recesses or elsewhere in the video tombstone 100, as desired. An optional sliding door 502 covers the visual display 108, for protection thereof from the elements, from vandalism, etc.

Figure 2:
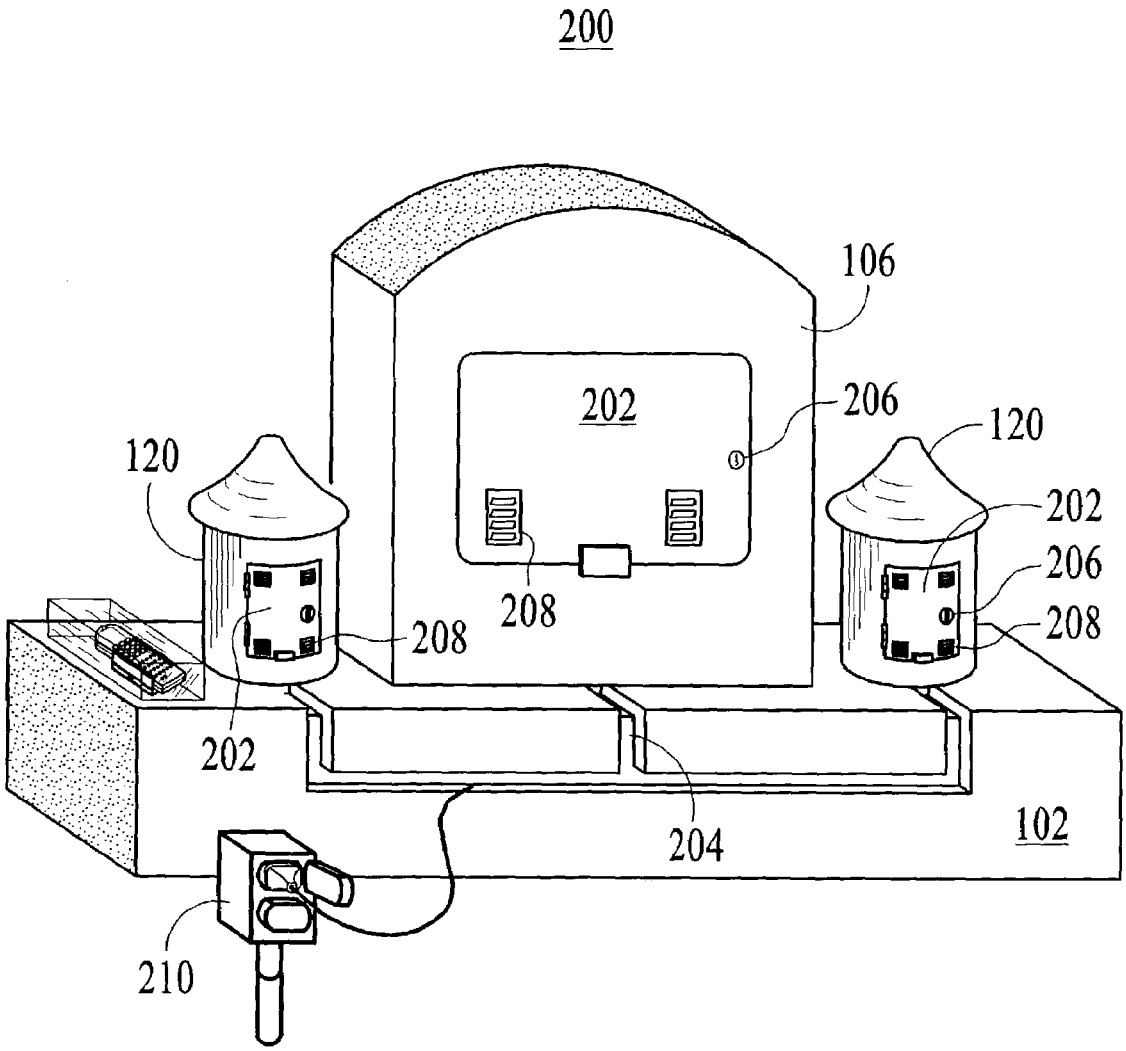
FIG. 2 is a representative isometric back view of a preferred embodiment of an improved apparatus for a video tombstone such as shown in FIG. 1.

FIG. 2 is a representative isometric back view of a preferred embodiment of an improved apparatus for a video tombstone 100 such as shown in FIG. 1. From the rear side 200 of the video tombstone 100, an access door 202 is mounted on the housing portion 106. The access door 202 provides access to an interior chamber (not shown) for housing the various components used in the video tombstone 100 of the present invention. Additionally, any wiring harness including poser, control, data or other wiring can be imbedded in grooves or tracks 204 in the base portion 102 which descend from and communicate between the housing portion 106 and the speaker housings 120. The access door 202 can be locked using locking mechanism or structure 206. Exterior vents 208 mounted on the access door 202 can also communicate through the access door 202 to an inside or inner chamber (not shown). Similarly, access doors 202 on the speaker housings 120 can also comprise locking apparatus 206 and vents 208.

The video tombstone 100 of the present invention also includes appropriate power source 210. While shown as a representational, standard outdoor weather-proof 110–220 VAC or DC power outlet 210, the power source 210 also includes UPS systems, back-up power systems, power distribution and transformation and other power conditioning systems for operating and control, recording, broadcast and viewing, data acquisition, storage, processing, receipt and transmission, etc., and other processes of the video tombstone 100.

Figure 3A:
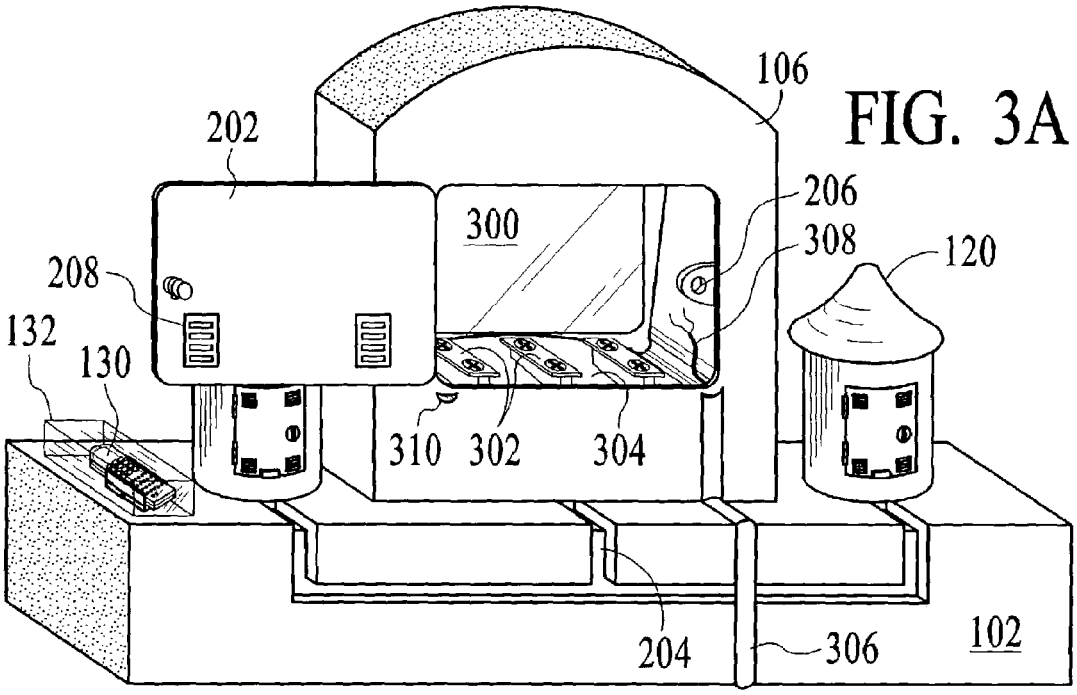
FIG. 3A is a representative isometric back view of a preferred embodiment of an inside chamber of the improved apparatus for a video tombstone such as shown in FIG. 1.

FIG. 3A is a representative isometric back view of a preferred embodiment of an inside chamber 300 of the improved apparatus for a video tombstone 100 such as shown in FIG. 1. As shown, an inside chamber 300 is revealed by opening the access door 202. Slide rails 302 or rails with slats are attached to the floor surface 304 to allow easy access and movement of equipment mounted thereon, moving said equipment into and out of the chamber portion 300, these slide rails 302 also form a platform on which to mount video and electronic equipment used within the video tombstone 100 of the present invention. Wiring harness conduit for control and power, and other utilities or signals, can be disposed within external conduit or groove portion 306. Wiring leads 308 for control and power, and other utilities or signals, terminate within the chamber 300.

Also, an optional drainage duct 310 allows moisture to drain away from the outside or the inside of the system 100, away from internals. The drainage duct 310 can be integrally built so as to be hidden from the outside of the system 100 or can be an exposed, externally fixed gutter, downspout or other channel.

Figure 3B:
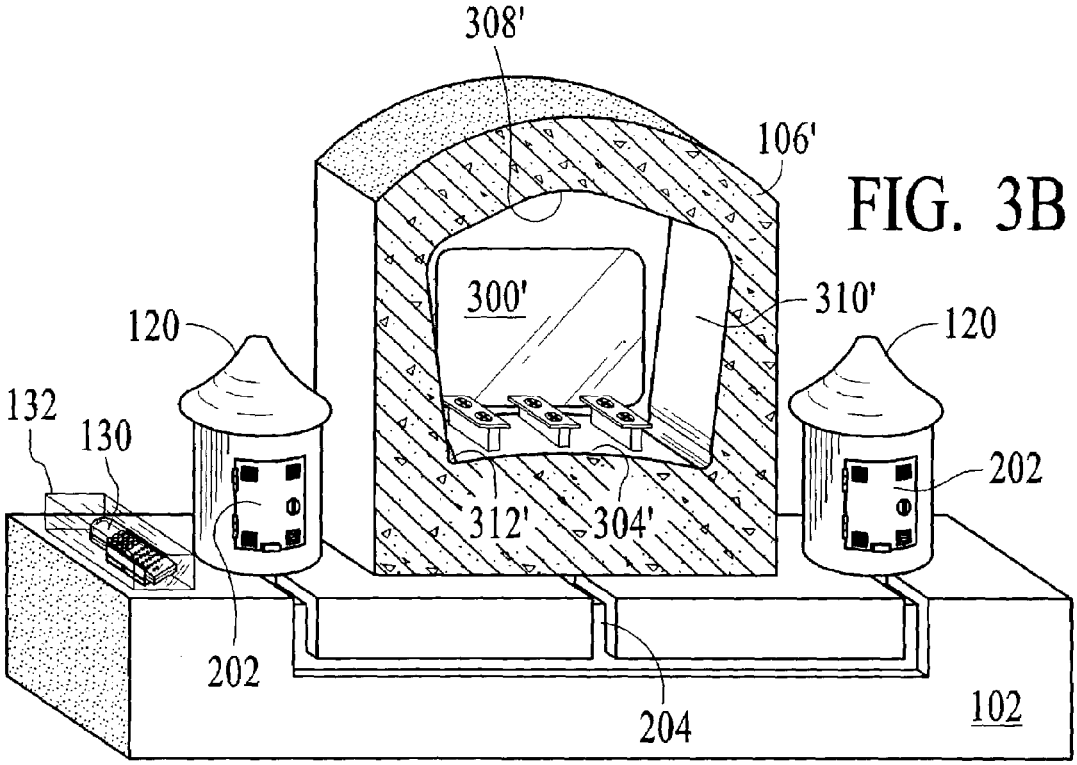
FIG. 3B is a representative isometric back view of another preferred embodiment of an inside chamber of the improved apparatus for a video tombstone such as shown in FIG. 1.

FIG. 3B is a representative isometric back view of another preferred embodiment of an inside chamber 300' of the improved apparatus for a video tombstone 100 such as shown in FIG. 1. In this embodiment, showing a cross section of the housing portion 106', the floor surface 304' is curved to allow improved air flow as well as drainage of any moisture or liquid which might condense or leak into the interior chamber 300' of the video tombstone 100. Additionally, the ceiling surface 308' and side walls 310' also allow drainage or condensation from within the interior chamber 300', through side gutters 312' and out the drainage duct 310 as shown in FIG. 3A.

Figure 4:
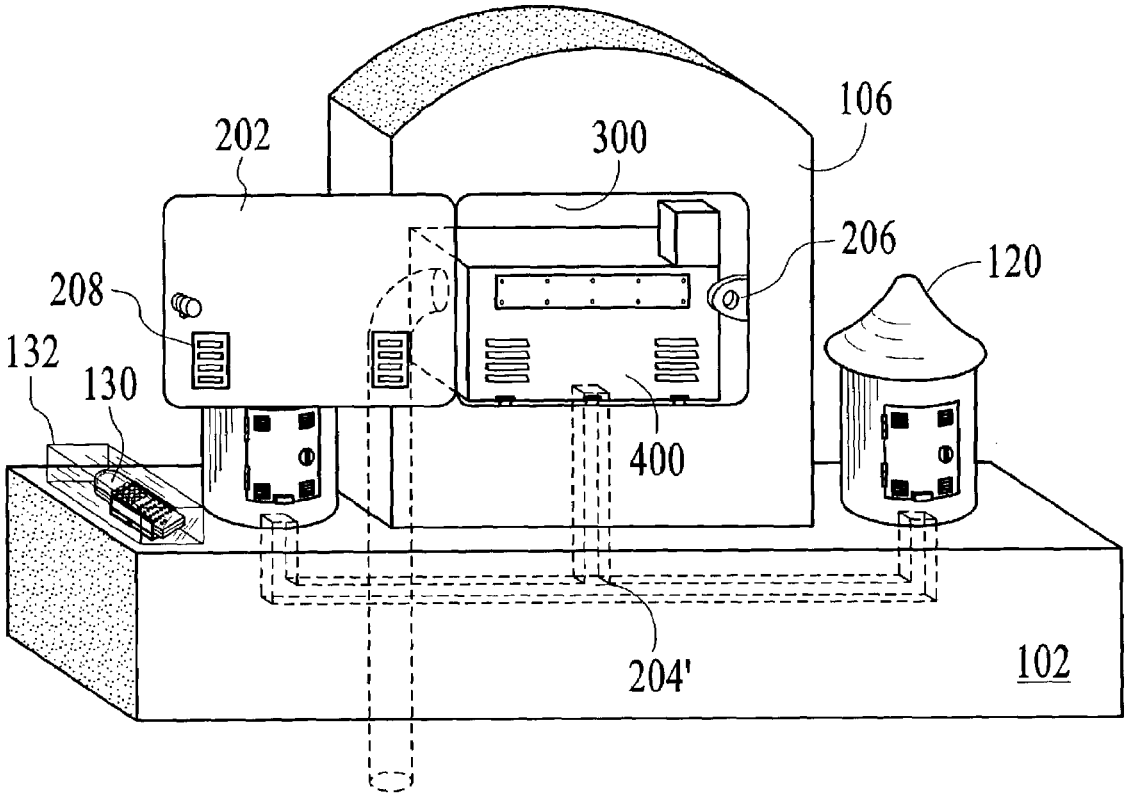
FIG. 4 is a representative isometric back view showing a preferred embodiment of various components inside the inside chamber of the improved apparatus for a video tombstone such as shown in FIG. 1.

FIG. 4 is a representative isometric back view showing a preferred embodiment of various components 400 inside the inside chamber 106 of the improved apparatus for a video tombstone 100 such as shown in FIG. 1. As described above, the various components 400 include a standard television monitor, other CRT or any flat panel, LCD, LED, plasma, crystal or thin film visualization display or monitor or other viewing means. Additionally, the various components 400 include can include a video playback mechanism in the case of video storage of data. Additionally, the various components 400 include players, readers or drivers for any type of data storage device which could conveniently be utilized in the present invention, including other types of video or film, DVD, CD, hard drive, flash memory chip or card or other digital storage means, traditional phonographic means including vinyl record, 8-track and standard cassette tape, or other magnetic tape, etc. The various components 400 also optionally include any appropriate and convenient recording device for family, friends, viewers or other users of the improved video tombstone 100 of the present invention, which includes recorders for all the above listed types of memory storage devices, video and still cameras, digital cameras and other digital recording devices. The various components 400 also optionally include other lenses and filters, appropriate optics, optional light source such as flash bulb, flash lighting, strobe lighting, etc. Other various components 400 also optionally include telecommunication devices including telephonic equipment, digital data processing equipment, faxes, modems, cable and internet access, including DSL or cable or ISDN, T1 data lines, television, satellite and radio and microwave and RF communications systems, other types of receivers and transmitters. Other various components 400 also optionally include computer processors, math and RISC processors and co-processors, PC and MAC operating systems, other computer and electronic architecture and systems, associated software, firmware and hardware. Other various components 400 also include appropriate power sources, UPS systems, back-up power systems, power distribution and transformation and other power conditioning systems for operating and control, recording, broadcast and viewing, data acquisition, storage, processing, receipt and transmission, etc., and other processes.

All of these various components 400 can be interconnected and vented, powered, through external grooves or conduits such as 204 and 306 as well as by internal, hidden channeling 204'. This imbedded, hidden channeling 204' can be conveniently utilized to organize and secure, protect and access the improved video tombstone 100 of the present invention.

Figure 5:
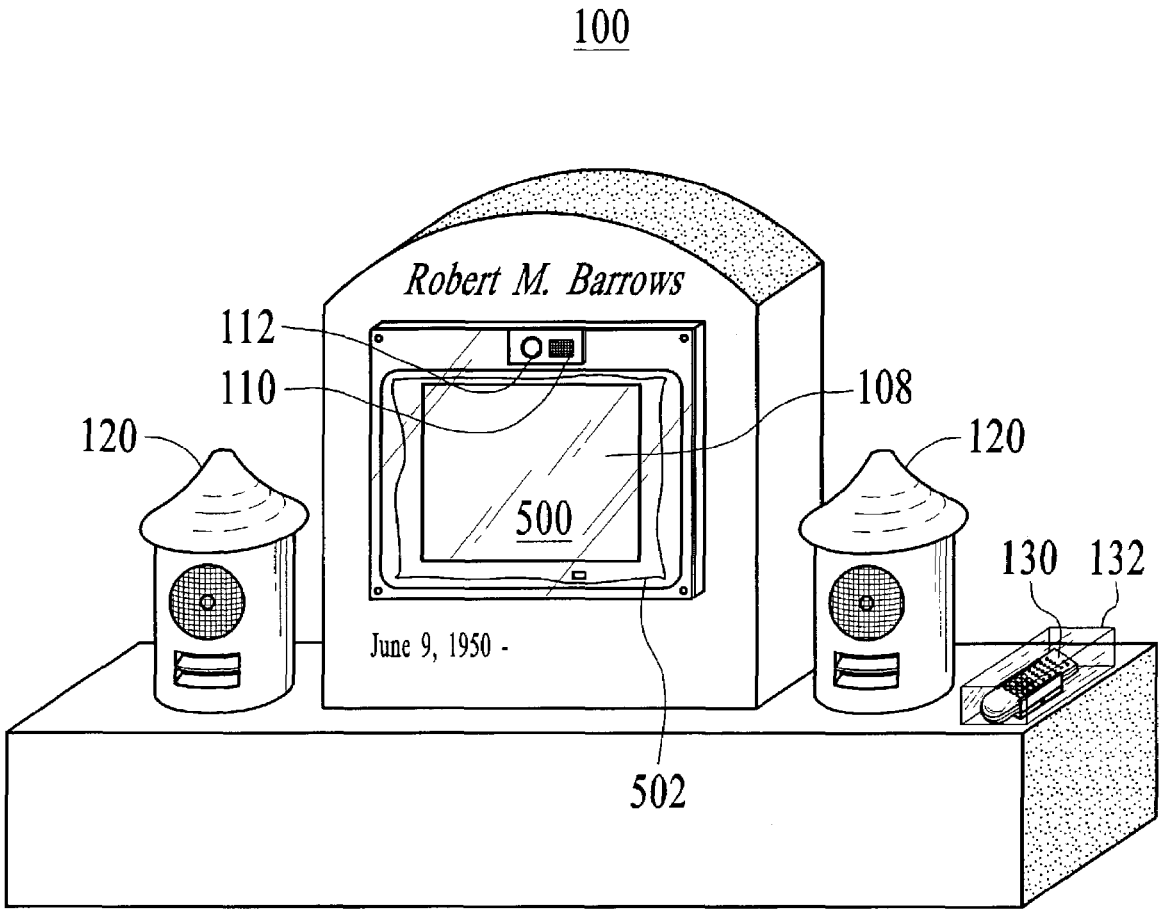
FIG. 5 is a representative isometric front view of another preferred embodiment of an improved apparatus for a video tombstone such as shown in FIG. 1.

FIG. 5 is a representative isometric front view of another preferred embodiment of an improved apparatus for a video tombstone 100 such as shown in FIG. 1. As described above, in the case of utilizing an existing tombstone, or otherwise, the monitor or display 108 can be a flat panel device 500. Additionally, it will also be understood that in an improved embodiment of the present invention, the flat panel device 500 or other monitor or display 108 also includes a wire or similar resistive heating element defroster or defogging mechanism 502, optionally with a timing and heating adjustment device. In a preferred embodiment, the heating element 502 can be activated by remote control 130 and powered and controlled by power and control lines utilized in the video tombstone 100.

Figure 6:
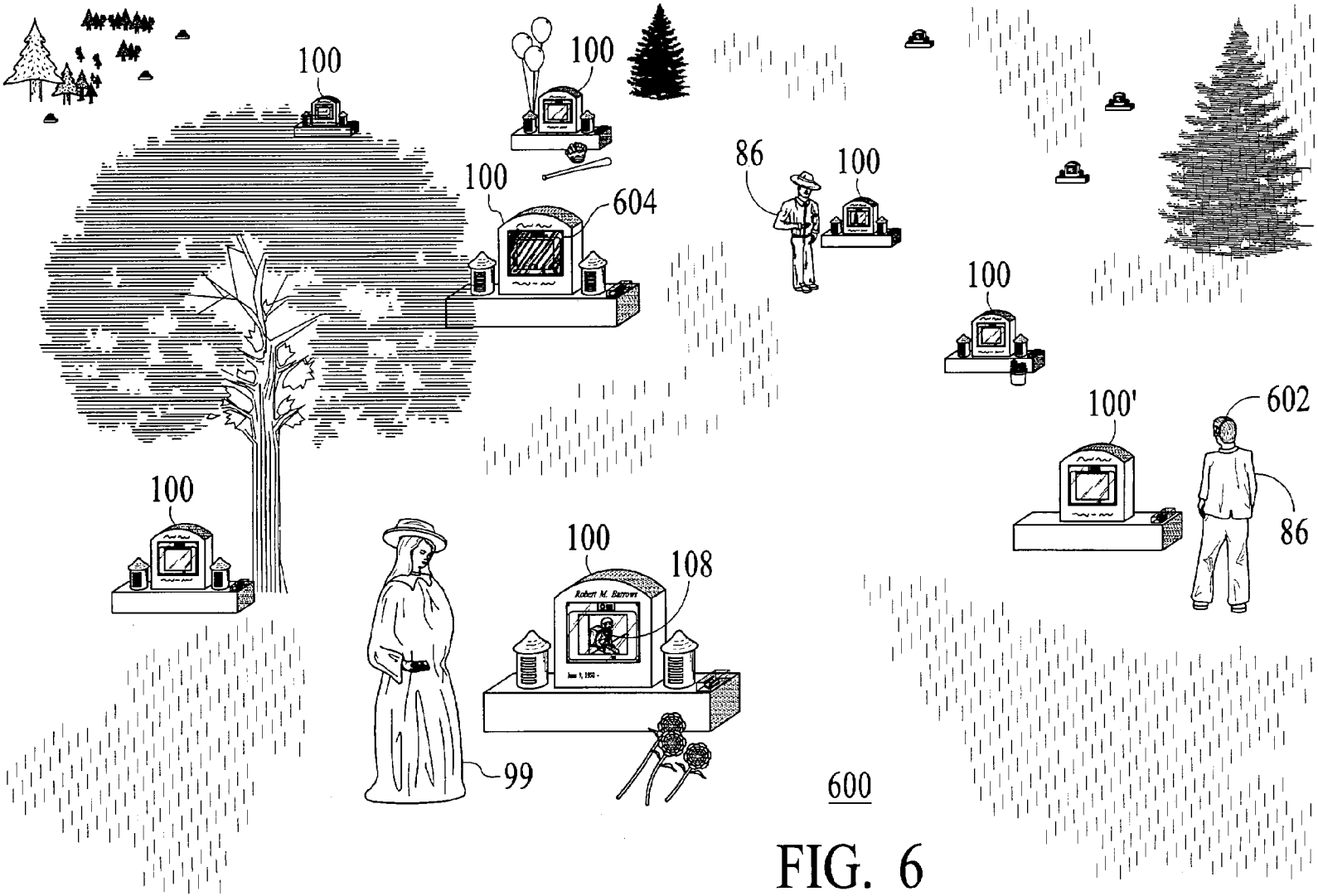
FIG. 6 is a representative perspective view of a preferred embodiment of a method of use an improved apparatus for a video tombstone such as shown in FIG. 1.

FIG. 6 is a representative perspective view of a preferred embodiment of a method of use an improved apparatus for a video tombstone 100 such as shown in FIG. 1. As described above, when a user 99 or 86 is in the vicinity of the video tombstone 100 of the present invention, such as within a cemetery or columbarium situation 600, visualization of the display 108 or the flat panel display 500 is possible. Audio signals, in the form of sound waves emanating from the speakers and housings 120 can be intercepted and perceived by a user 99. Additionally, in the case of a video tombstone 100' in which the audio signals are transmitted electronically via radio waves, RF or other transmitting means, to a corded or wireless headset 602 worn by a user 86, the system 100' does not require external speakers or housings 120. Additionally, the user 99 or 86 can be recorded or photographed utilizing microphone 110 or camera 112 as described above.

The front of the video tombstone 100 also optionally includes a protective window 604, optionally made of thin plexiglass or other transparent, protective material, to protect the television or other monitor or screen 108 from the elements and intrusion by vandals, animals, etc. The protective window 604 can also comprise a sliding plastic, slightly curved cover shield to protect the screen 108 and to blend in with the surroundings. This cover shield 604 can be colored the same color as the tombstone, or different. The sliding front shield would slide on small rails and could be operated by remote control or manually. The purpose of the shield 604 is to hide the screen 108 so the tombstone 101 can blend in with the surroundings as well as to further protect the device 101 from the elements.

Figure 7A:
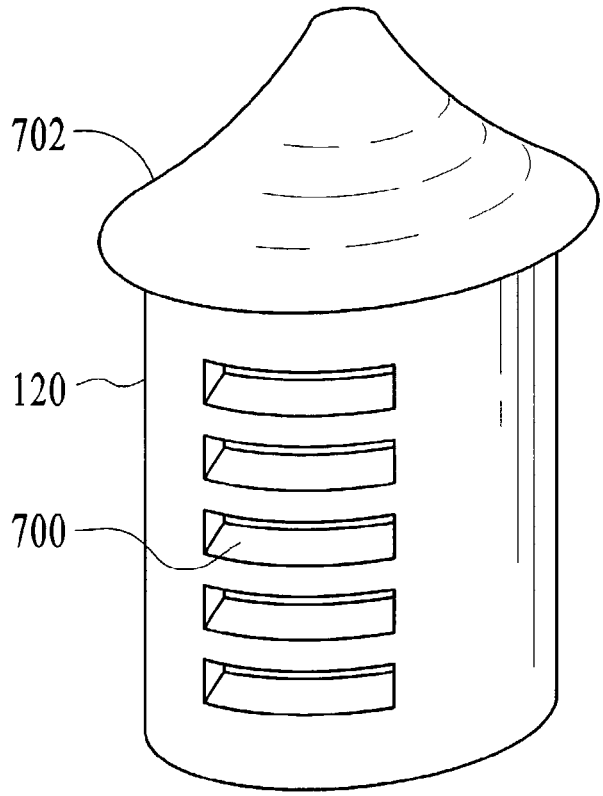
FIG. 7A is a representative detail front view of a preferred embodiment of a speaker housing of an improved video tombstone such as shown in FIG. 1.
Figure 7B:
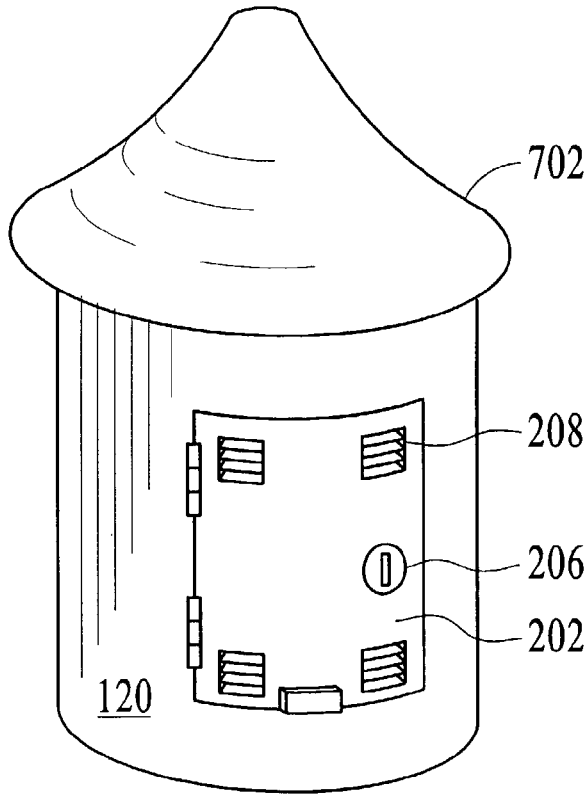
FIG. 7B is a representative detail back view of a preferred embodiment of a speaker housing such as shown in FIG. 7A.

FIG. 7A is a representative detail front view of a preferred embodiment of a speaker housing of an improved video tombstone 100 such as shown in FIG. 1. FIG. 7B is a representative detail back view of a preferred embodiment of a speaker housing 120 such as shown in FIG. 7A. As described, the back door 202 has a lock 206 and vent portion 208. Additionally, vents 700 in the front of the speaker housings 120 allow and direct sound waves through the housing 120 to a listener 99 or 86. Additionally, the slanted roof portion 702 allows rain or other water or fluid to drain off of the housing 120.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A tombstone for communicating audio and visual data related to the deceased from the tombstone to a user, the tombstone comprising:

an indicia bearing and viewing portion;

a visual display with a cover shield with sliding door which covers the visual display, for protection thereof the cover shield comprising a heating element located within the cover shield for defogging or defrosting thereof;

an access door on the rear of the tombstone for access to an interior chamber, the access door having one or more vents for improved air flow;

a weather-proof interior chamber having interior surfaces including slanted walls and a curved floor which allow drainage of condensate and liquids and improved air flow, the interior chamber further defined by a set of slide rails for convenient mounting and movement and ventilation of video and electronic equipment used within the tombstone;

an audio transmitter for communicating sound waves to a user, the audio transmitter comprising a speaker;

data related to the deceased located within the interior chamber, the data comprising audio and visual images of the deceased, the data stored within storage media;

means for reproducing the audio and visual images of the deceased from the data related to the deceased utilizing one or more players, readers or drivers also located within the interior chamber; and a camera and microphone for recording audio and visual data.

2. The tombstone of claim 1 in which the visual display is one or more selected from the group consisting of a television monitor, CRT or any flat panel, LCD, LED, plasma, crystal or thin film visualization display or monitor.

3. The tombstone of claim 1 in which the storage media is selected from the group consisting of video, film, DVD, CD, hard drive, floppy disk, flash memory chip or card, traditional phonographic means including vinyl record, 8-track and standard cassette tape, computer server, internet based websites and webpages.

4. The tombstone of claim 1 in which the one or more players, readers or drivers for the one or more of the storage media is selected from the group consisting of video player, film projector, DVD player, CD player, hard drive interface, floppy drive, memory chip or card reader record player, 8-track player and standard cassette tape player, client computer, and network computer.

5. The tombstone of claim 1 further comprising a wireless user headset for listening to the audio data transmitted by the tombstone.

6. The tombstone of claim 1 in which the tombstone is secure from vandalism.

7. The tombstone of claim 1 further including one or more of the devices in the group consisting of telecommunication devices including telephonic equipment, digital data processing equipment, faxes, modems, cable and internet access, including DSL or cable or ISDN, T1 data lines, television, satellite and radio and microwave and RF communications systems.

8. The tombstone of claim 1 further including one or more of the devices in the group consisting of power sources, UPS systems, back-up power systems, power distribution and transformation and for operating and control, recording, broadcast and viewing, data acquisition, storage, processing, receipt and transmission.

9. The tombstone of claim 1 further including one or more of the devices in the group consisting of computer processors, math and RISC processors and co-processors, PC and MAC operating systems, firmware and hardware.

* * * * *